United States Patent [19]

Buescher et al.

[11] 3,958,146

[45] *May 18, 1976

[54] FAST WARM UP PICTURE TUBE CATHODE CAP HAVING HIGH HEAT EMISSIVITY SURFACE ON THE INTERIOR THEREOF

[75] Inventors: William E. Buescher; Donald R. Kerstetter, both of Emporium, Pa.

[73] Assignee: GTE Sylvania Incorporated, Stamford, Conn.

[ * ] Notice: The portion of the term of this patent subsequent to Apr. 29, 1992, has been disclaimed.

[22] Filed: Feb. 8, 1974

[21] Appl. No.: 440,683

[52] U.S. Cl. ..... 313/346 R; 313/37; 313/40; 313/337; 313/270; 427/77

[51] Int. Cl.² ..... H01J 1/14; H01J 19/06; H01K 1/04

[58] Field of Search ..... 313/337, 341, 346, 270, 313/271, 37, 38, 41, 45; 427/77

[56] References Cited

UNITED STATES PATENTS

| | | | |
|---|---|---|---|
| 1,555,677 | 9/1925 | Leblanc | 313/41 X |
| 2,013,419 | 9/1935 | Moran | 313/41 |
| 2,057,124 | 10/1936 | Gessel et al. | 313/41 X |
| 2,146,098 | 2/1939 | Gessel et al. | 313/41 |
| 2,236,289 | 3/1941 | Hull | 313/37 |
| 2,472,189 | 6/1949 | Bienfait et al. | 427/77 |
| 2,717,975 | 9/1955 | Wihtol | 313/341 X |
| 2,723,363 | 11/1955 | DeSantis et al. | 313/270 |
| 2,847,604 | 8/1958 | Beggs et al. | 313/341 X |
| 2,878,410 | 3/1959 | Millis | 313/337 X |
| 3,005,926 | 10/1961 | Horner et al. | 313/337 |
| 3,262,814 | 7/1966 | provisor | 427/77 |
| 3,326,648 | 6/1967 | Provisor | 427/77 X |
| 3,374,385 | 3/1968 | Lattimer | 313/337 |
| 3,376,461 | 4/1968 | Millward | 313/37 X |
| 3,881,124 | 4/1975 | Buescher et al. | 313/446 |

*Primary Examiner*—Saxfield Chatmon, Jr.
*Attorney, Agent, or Firm*—Norman J. O'Malley; William H. McNeill; Cyril A. Krenzer

[57] ABSTRACT

Performance of fast warm up cathodes can be improved by providing a black heat radiating surface on the interior of the cathode cap. A particular material can be nichrome which is a nickel chromium alloy. The cathode cap material can be selected from any of the known cathode nickel alloys. A preferred method for accomplishing the result includes the steps of cladding a selected nickel alloy with the nichrome material and then forming the substantially cup shaped cap with the clad material on the interior thereof. The formed cathode cap is then fired for about 10 minutes or longer in wet dissociated ammonia at a temperature of about 900° to 1300°C to oxidize the available chromium on the surface of the nichrome. This produces an even dark surface thereon which has much higher heat radiating capabilities than the silver looking nickel cathode alloy.

4 Claims, 2 Drawing Figures

FAST WARM UP PICTURE TUBE CATHODE CAP HAVING HIGH HEAT EMISSIVITY SURFACE ON THE INTERIOR THEREOF

BACKGROUND OF THE INVENTION

This invention relates to fast warm up cathodes and more particularly to fast warm up cathodes for use in cathode ray tubes.

In the past, many types of fast warm up cathodes have been proposed; however, most have not been commercially acceptable because of high failure rates or prohibited costs. To accomplish the same result many manufacturers of television receivers have adopted a so called "instant on" feature which provides heater current to all of the tubes in the receiver even if it is "off". While this system is very successful in accomplishing its purpose, it is very wasteful of electrical energy.

To rectify the energy waste, attention again turned to providing a fast warm up cathode; that is, a cathode which reaches operating temperature and provides a viewable picture on the screen of a cathode ray tube in the neighborhood of about 5 seconds. Such a cathode has recently been developed and is shown and described in U.S. patent application Ser. No. 409,041, now U.S. Pat. No. 3,881,124, assigned to the assignee of the present invention, the disclosure of which is here and incorporated by reference.

Such a cathode comprises basically a cup shaped cap having electron emissive material on the outer surface of the closed end thereof and a cathode stack which is attached to the cap by low heat conducting ribbons. A suitable heater is disposed within the cathode stack and cap. This structure works extremely well for its designed purpose but could be improved even further if the heat radiated from the heater could be conducted more readily and rapidly to the top cap of the cathode.

OBJECTS AND SUMMARY OF THE INVENTION

It is, therefor, an object of this invention to obviate the disadvantages of the prior art.

It is another object of the invention to enhance cathode warm up time in a fast warm up cathode.

Still another object of the invention is to improve the heat radiation from the cathode heater to the top cdp area of the cathode.

These objects are accomplished in one aspect of the invention by the provision of a fast warm up cathode which comprises a hollow cathode stack. A substantially cup shaped cathode cap is connected thereto by means of minimum area contact means. A suitable heater is positioned within the cap and the stack. The cathode cap comprises a clad material having at least two layers, the outer of these layers being selected from the group consisting of nickel and cathode nickel alloys and the inner of said layers being selected from the group of materials which will provide a high heat radiating surface. The high heat radiating surface applied to the interior of the cathode cap substantially increases the rate at which heat is conducted thereinto and thus substantially increases the rate at which electron emission will occur in suitable quantities to provide a raster on the screen of a cathode ray tube.

DESCRIPTION OF THE PREFERRED EMBODIMENTS

For a better understanding of the present invention together and with other and further objects, advantages and capabilities thereof, reference is made to the following disclosure and dependent claims in connection with the above described drawings.

Figure 1:
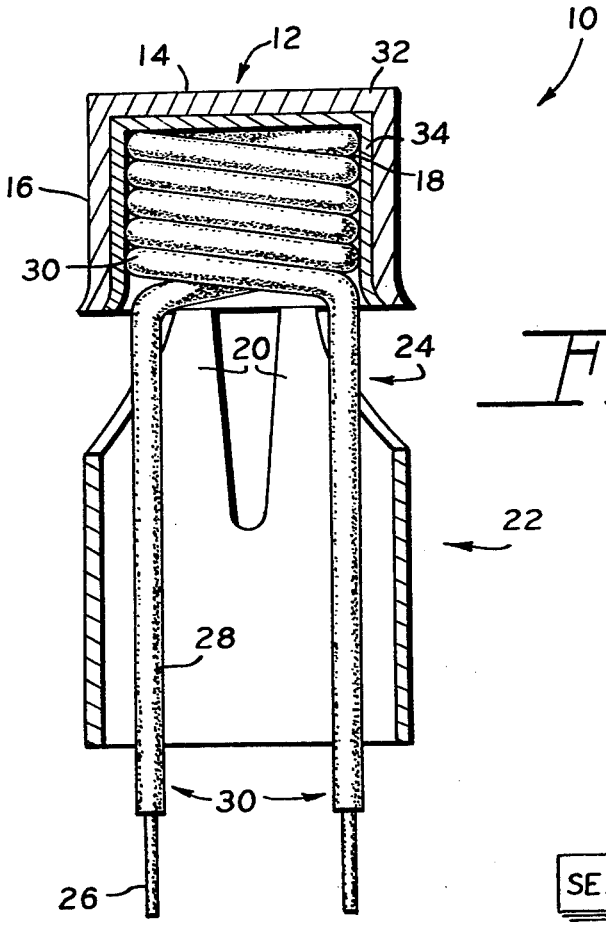
FIG. 1 is a cross sectional elevational view of a cathode constructed in accordance with the invention.

Referring now to the drawings with greater particularity there is shown in FIG. 1 a fast warm up cathode 10 comprising a top cap 12 which is substantially cup shaped and includes a closed end 14 having a peripheral side wall 16 defining a hollow interior 18.

Top cap 12 is supported by a plurality of minimum contact areas 20 formed as part of a hollow cathode sleeve 22.

A heater 24 having an electrically conductive core 26 of a suitable material such as tungsten or molybdenum surrounded by an electrically insulated coating 28, of a suitable material, such as alumina, is positioned within the cathode 10. The heater 24 is formed to provide a coiled portion 30, which is of small height compared with the height of the heater, which body portion is encompassed within the hollow interior 18 of top cap 12. A pair of heater legs 32 extend from body 30 through sleeve 22.

The top cap 12 is formed from a clad material having at least two layers, the outermost of these layers being selected from the group consisting of nickel and cathode nickel alloys and being shown generally as 32, and the inner of these layers 34 being selected from the group of materials which will provide a high heat radiating surface. This high heat radiating surface is generally black or extremely dark gray. A preferred material is an alloy comprised essentially of about 20% chromium with the remainder being essentially nickel. Such materials are readily available in commerce and two particular types are known respectively as Tophet A available from the W. B. Driver Co. and Nichrome available from the Driver Harris Co. The inner material should be as thin as possible to accomplish the purpose and thicknesses of from 4 to 20% of the total thickness of the clad material should be employed. A preferable thickness is about 6½% of the total thickness of the clad material. As the thickness of the clad material particularly that of the inner layer increases there is a danger of the clad material beginning to function as a bi-metal wherein the different coefficients of thermal expansion could under long or severe operating conditions cause a defermation of the top cap.

Other materials than the nickel chrome alloy could be used as the inner layer and another possible choice is an alloy comprised of about 4% manganese with the remainder being essentially nickel.

Figure 2:
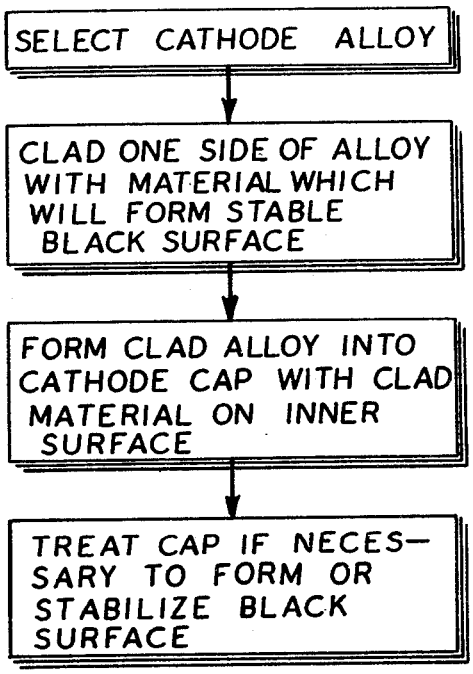
FIG. 2 is a flow diagram of one process for forming such a heat radiating surface.

To form the cathode a suitable nickel or nickel cathode alloy is prepared and then clad with the high heat radiating surface material. With the material applied the top cap is conventionally formed by a dye drawing operation and then to darken the surface the top cap is fired for about 10 minutes or longer in a wet dissociated ammonia atmosphere at about 900° to 1300°C. The firing operation will oxidize the available chromium on the surface of the inner layer (when a nickel chromium alloy is used) and provide the black high heat radiating surface. The cathode processing technique is shown in the flow diagram of FIG. 2.

It will be readily apparent that it is entirely possible that materials may exist which could be applied in a darkened black condition without needing any further firing in order to provide the high heat radiating surface and such materials are contemplated as being within the scope of the present invention. Furthermore, it should also be noted that it would be possible to fire the clad material before the top cap is formed therefrom.

Known cathode nickel alloys can be found at least partially compiled in "Materials and Techniques For Electron Tubes" by Walter H. Kohl copyright 1960 and published by the Rheinhold Publishing Corporation, New York, New York.

While there have been shown what are at present considered the preferred embodiments of the invention, it will be apparent to those skilled in the art that various changes and modifications can be made herein without departing from the scope of the invention as defined by the appended claims.

What is claimed is:

1. In a fast warm up cathode which comprises a hollow cathode stack, a substantially cup-shaped cathode cap, minimum area contact means joining said stack and said cap, and a heater positioned within said cap and said stack, the improvement comprising: an inner layer of a high heat radiating material which is substantially black on the interior of said cap, said inner layer being an alloy comprised essentially of about 20% chromium with the remainder essentially nickel.

2. The cathode of claim 1 wherein the thickness of said inner layer comprises from about 4 to about 20% of the total thickness of said cap.

3. In a fast warm up cathode which comprises a hollow cathode stack, a substantially cup-shaped cathode cap, minimum area contact means joining said stack and said cap, and a heater positioned within said cap and said stack, the improvement comprising: an inner layer of a high heat radiating material which is substantially black on the interior of said cap, said inner layer being an alloy comprised essentially of about 4% manganese with the remainder essentially nickel.

4. The cathode of claim 3 wherein the thickness of said inner layer comprises from about 4 to about 20% of the total thickness of said cap.

* * * * *